United States Patent [19]

Swisher

[11] 3,937,392

[45] Feb. 10, 1976

[54] KNOCK-DOWN, COLLAPSIBLE, DRUM CONTAINER

[75] Inventor: Robert Allen Swisher, Long Valley, N.J.

[73] Assignee: St. Regis Paper Company, New York, N.Y.

[22] Filed: Nov. 1, 1974

[21] Appl. No.: 520,125

[52] U.S. Cl. ..... 229/41 C; 229/23 A; 229/5.5; 229/43; 220/320

[51] Int. Cl.[2] ..... B65D 5/36; B65D 5/64

[58] Field of Search ..... 220/286, 306, 319, 320; 229/4.5, 5.5, 5.6, 6, 41 C, 23 A, 23 BT, 14, 43

[56] References Cited

UNITED STATES PATENTS

| | | | |
|---|---|---|---|
| 486,800 | /1892 | Thomson | 229/5.5 |
| 1,526,396 | 2/1925 | Tandy | 220/320 |
| 2,033,888 | 3/1936 | Bombard | 229/4.5 |
| 3,331,547 | 7/1967 | Gallo | 229/5.5 |
| 3,499,574 | 3/1970 | Yates, Jr. | 220/320 |

*Primary Examiner*—William Price
*Assistant Examiner*—Douglas B. Farrow
*Attorney, Agent, or Firm*—Cooper, Dunham, Clark, Griffin & Moran

[57] ABSTRACT

A knock-down, collapsible drum container assembly, comprising a pair of polygonal tubular members one adapted to fit within the other and comprising outer and inner tubular members of said container, each of said members being collapsible to a substantially flat state along oppositely disposed axially extending score lines thereof, end closures for said tubular members comprising pairs of inner and outer closure caps, said inner closure caps being configured to fit within said outer tubular member at the opposite ends thereof and having integral therewith radially extending flaps bendable along score lines to bear against the inner wall of said outer tubular member, said inner tubular member being configured to fit within and bear against said flaps as so disposed, said outer closure caps being configured to span the ends of said outer tubular member and having integral therewith radially extending flaps bendable along score lines into engagement with the outer wall of said outer tubular member, whereby said flaps may be clamped against said outer wall by clamping rings bearing thereagainst, said outer tubular member having preferably collared terminations at its opposite ends and said flaps of said outer caps being notched for seating said clamping rings at points above said collared terminations for locking engagement therewith by said clamping rings, said tubular members being preferably formed of substantially rectangular sheets of flexible material transversely scored at spaced intervals with opposite ends of said sheets joined to form said tubes.

7 Claims, 10 Drawing Figures

KNOCK-DOWN, COLLAPSIBLE, DRUM CONTAINER

This invention pertains to containers adapted for the bulk packaging of dry flow granular or powdered products, and more especially to a substantially drum shaped container therefor.

A primary object of the invention is to provide a container of novel construction and assembly within this category which may be shipped flat in knock-down form and thence assembled on site for filling, closure and shipment, and which on subsequent emptying may be knocked down and stored flat for reuse.

For the heavy duty packaging, transportation and shipment of dry flow materials, such as granular or powdered products, the choice of commercial containers lies between multiwall bags and drums, since other forms, such as boxes, etc., are unsuitable, being unduly cumbersome to handle and inherently ill adapted to a sift proof construction. Bags are quantity produced in a flat state and are shipped and stored as such, but are restricted to packaged bulks of about 50 to 100 pounds, by reason of structural limitations and lifting weights, and also require special equipment for filling, such as valve bag filling machines for valve bags, or for closing after filling, such as special field closure and sealing units for closing open ended bags, both requiring trained operators. Drum containers are inherently stronger than multiwall bags and can handle heavier bulk loads up to about 300–400 pounds with facility in that they can be rolled about without lifting and easily upended for emptying. They also inherently possess an open ended utility for filling, as from a gravity fed storage container, and for emptying, as by means of a suction line.

Insofar as I am aware, however, drum containers for the bulk packaging of dry flow products, as heretofore produced have been of a preformed, rigid construction, requiring excessive space for quantity shipment and storage. The present invention overcomes this objection while retaining the full advantages of drum containers as above discussed, by providing a drum container of knock-down, collapsible construction the components of which may be shipped and stored flat, but may be easily assembled by laymen, and without skilled operators, for filling and closure, and for subsequent unclosure and emptying.

The invention in its essentials comprises a novel combination of elements consisting of outer and inner collapsible tubular members together with a pair of inner and outer collapsible top and bottom end closure caps for said tubular members.

Both tubular members are formed of a relatively rigid but bendable and scorable material, such as corrugated board, fiber board, or the like. Each tube is formed from a substantially rectangular sheet of such material which is scored at spaced intervals to impart to the sheet a series of rectangular panels separated by the score lines. Each sheet is thence bent into tubular shape about the score lines until one paneled edge overlaps the corresponding opposite paneled edge and is bonded thereto, as by gluing. The outer tube is of slightly greater transverse dimensions than the inner tube, whereby the latter is insertable within the former both tubes being of substantially the same height. For shipping and storing, the tubes are pressed flat along oppositely disposed score lines and thence opened up or expanded for assembly.

On order to mount the outer end closure caps in locking assembly on the ends of the outer tube, as explained below, a terminal portion of said tube at each end thereof is reversely folded outwardly and against the outer wall thereof and bonded thereto as by gluing, to form collared tube ends thereon.

The outer and inner end closure caps for the tubes are blanked out from flat corrugated board or equivalent sheet stock to provide closure portions corresponding substantially to the transverse configurations of the outer and inner walls of the expanded outer tube, and as surrounded by a series of radially extending flaps bendable about basal score lines normal to the closure portions and corresponding in number to and spacing to the panels of the expanded outer tube. The flaps of the outer closure caps are provided with oppositely disposed notched edges for reception of a clamping ring to hold the caps in locked engagement on the collared ends of the outer tube as explained below. For shipment and storage, all caps are retained in the flat state as blanked out.

For providing an open ended assembly of the container components for filling, an outer cap is mounted on one end of the outer tube with its flaps aligned successively with the tube panels and with the flaps bent upwardly against the tube panels. As so mounted the notches in the flaps are disposed beyond the collared termination of the tube end and are encircled by a clamping ring to lock the cap against the collared tube end. The inner tube having an inner cap mounted thereon with its flaps bent upwardly along the outer wall of said tube, is then inserted in the open end of the outer tube and pushed down until the inner cap is seated on the outer cap. After the container is filled with the material to be packaged, an inner cap with its flaps bent down is inserted between the open ends of the outer and inner tubes, and an outer cap assembled onto the open end of the outer tube and clamped thereon in the manner above explained with reference to the bottom outer cap.

Having thus explained the invention in general terms, reference will now be had for a more detailed description of the above and other features of the invention, to the accompanying drawings illustrative of a preferred embodiment thereof wherein:

FIG. 3 is a longitudinal axial section of FIG. 1 as taken at 3—3 thereof; while

FIG. 7 is a plan view of a rectangular strip of corrugated board or equivalent as scored at spaced intervals for forming into the inner tubular member of the container assembly, while

FIG. 9 is a plan view of an inner closure cap as blanked out from a flat sheet of corrugated board or equivalent, while

Referring for the moment more particularly to FIGS. 1–6 inc., the container assembly comprises outer and inner tubular members 11, 12, together with top and bottom inner closure caps 13, 14, and top and bottom outer closure caps 15, 16.

Figure 7:
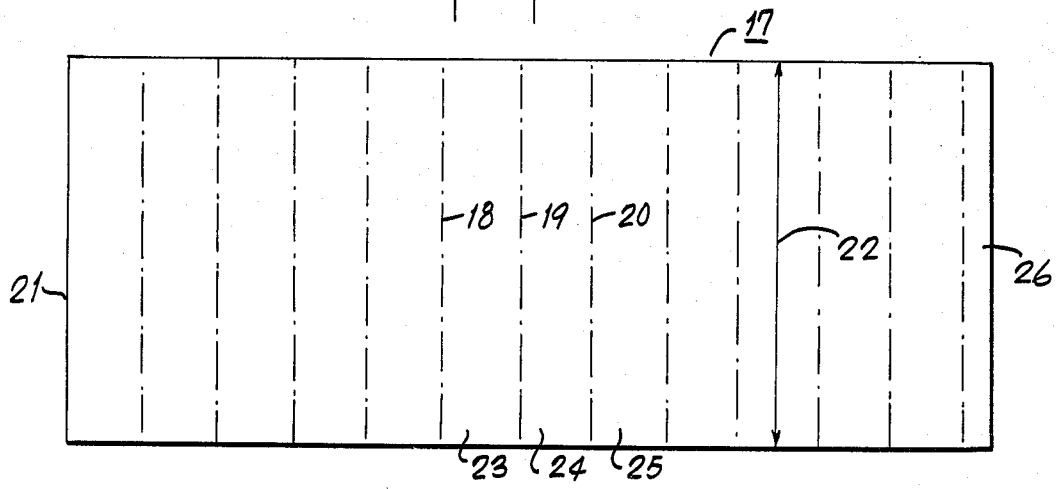

Referring to FIG. 7, the inner tubular member 12 is formed from a substantially rectangular sheet of corrugated board 17 or equivalent, which is scored at equi-spaced intervals, as at 18–20 inc., with score lines extending parallel to one edge 21 of the sheet and with the score lines extending the width 22 of the sheet, to divide the same into a series of rectangular panels, as at 23–25 inc., disposed between the score lines 18–20 inc. The so scored sheet is formed into a tube by overlapping the end 21 thereof with the opposite end 26 and bonding them together, as by gluing.

Figure 8:
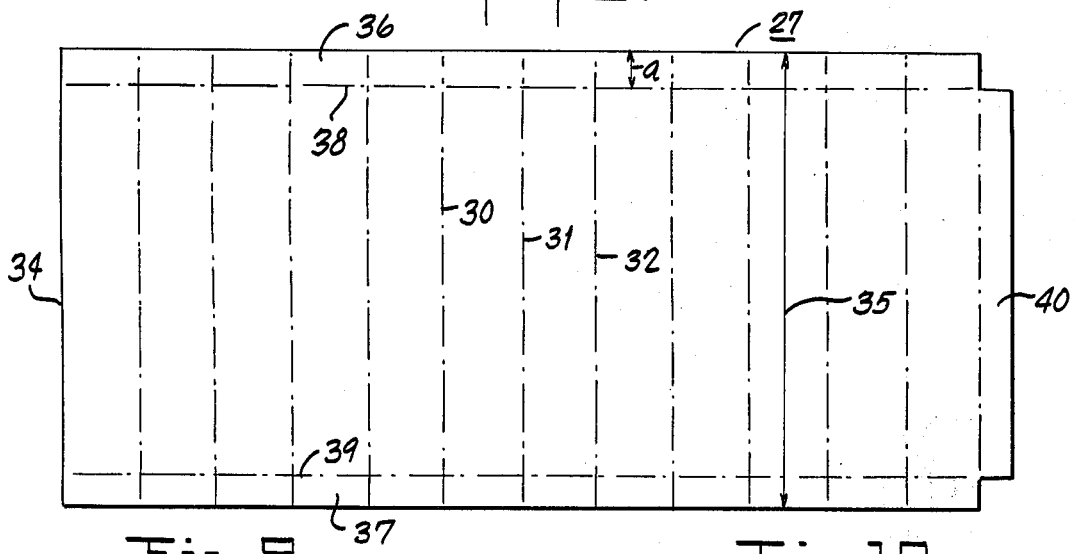
FIG. 8 is a similar view of a scored sheet of such material for forming into the outer tubular member.

Referring to FIG. 8, the outer tubular member 11, is formed in a manner similar to the inner tubular member 12, by similarly scoring a substantially rectangular sheet 27 of the aforesaid material, with equi-spaced, score lines, as at 30–32 inc., parallel to one edge 34 thereof, and extending transversely across the sheet width 35. Prior to forming the outer sheet into a tubular member, oppositely disposed edge portions 36, 37 thereof are reversely folded along lines 38, 39 and bonded to one face of the sheet. The sheet is thence formed into a tubular member by looping one edge 34 over into overlapping relation with the opposite edge 40 and bonding together, the looping being in such direction that the reversely folded edge portions 36, 37 are disposed on the outer wall of the tube best shown at 36, 37, FIG. 2, to form collared terminations thereon of a height *a*.

Figure 2:
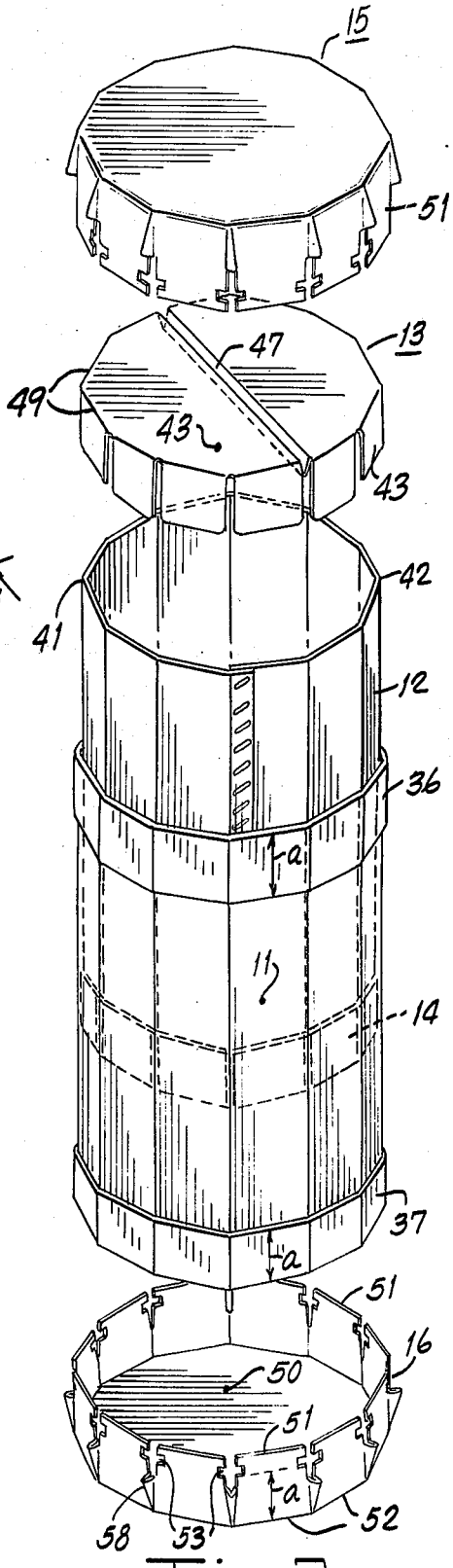
FIG. 2 is an exploded perspective view of the assembly of FIG. 1.

For purposes of shipping and storage the outer end inner tubular members are pressed flat along oppositely disposed score lines, as at 41, 42, FIG. 2, but are opened up or expanded for subsequent assembly of the container into tubular form shown in FIG. 2.

Figure 9:
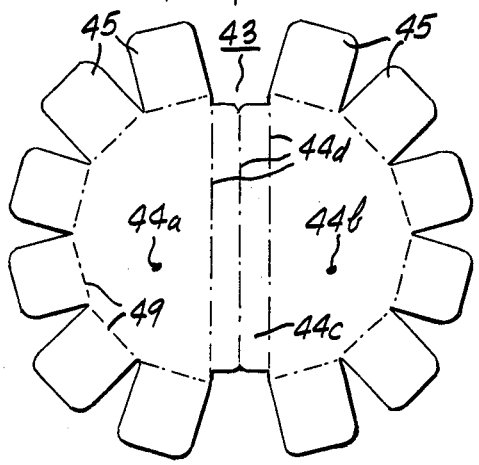

Referring to FIG. 9 the inner end closure caps 13, 14, are blanked out from flat corrugated board sheet stock to the configuration shown generally at 43 of FIG. 9, comprising a pair of substantially semi-circular, polygonal closure portions 43*a*, 43*b*, each having a plurality of flaps extending radially therefrom, as at 45, with the closure portions 44*a*, 44*b*, joined by a substantially rectangular portion 44*c*. Portion 44*c* is scored along spaced parallel diametrically extending score lines, as at 44*d*, and is reversely bent along these score lines to provide a strengthening rib for each cap, as at 47, 48, FIGS. 1–3 inc.

Figure 3:
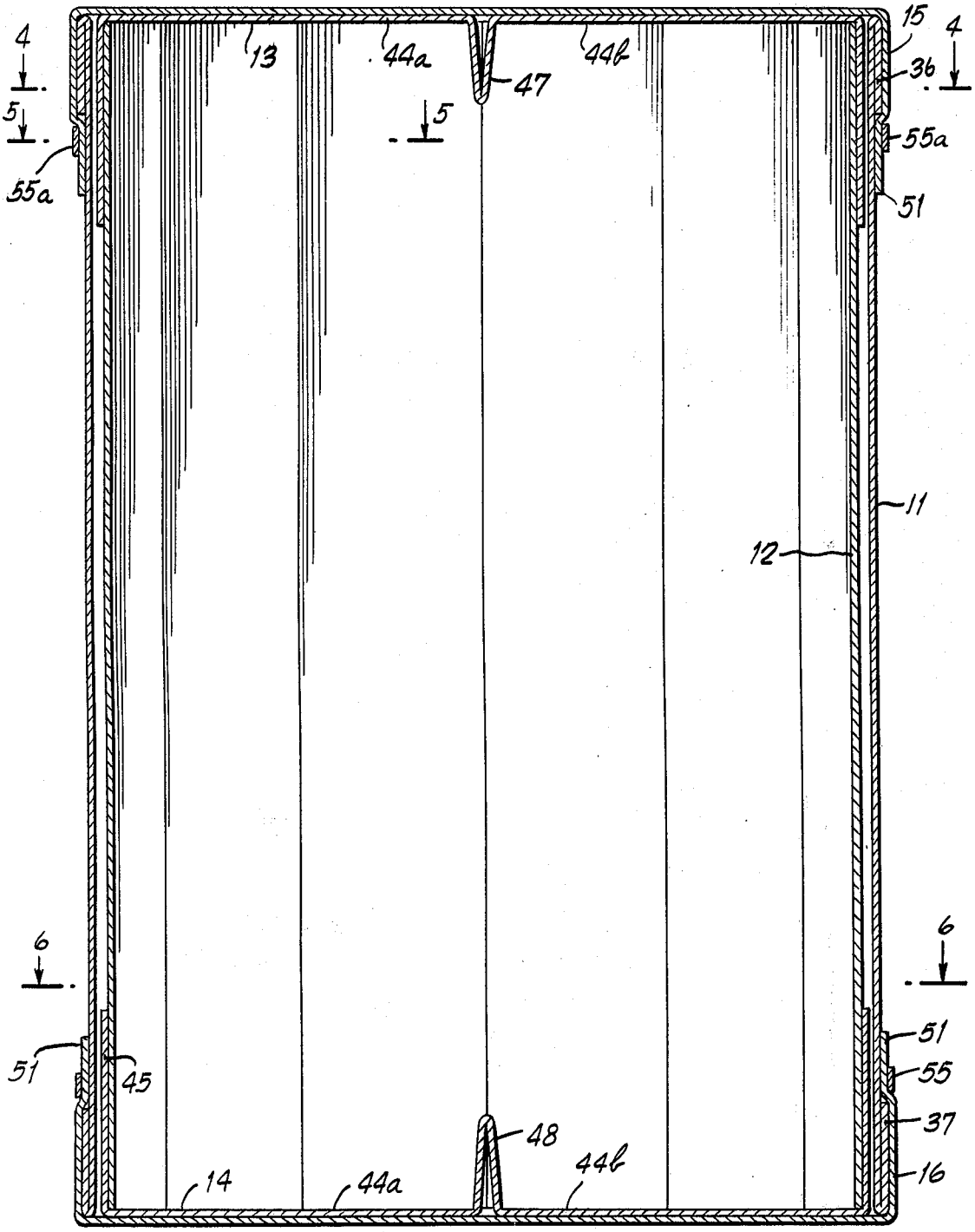
Figure 4:
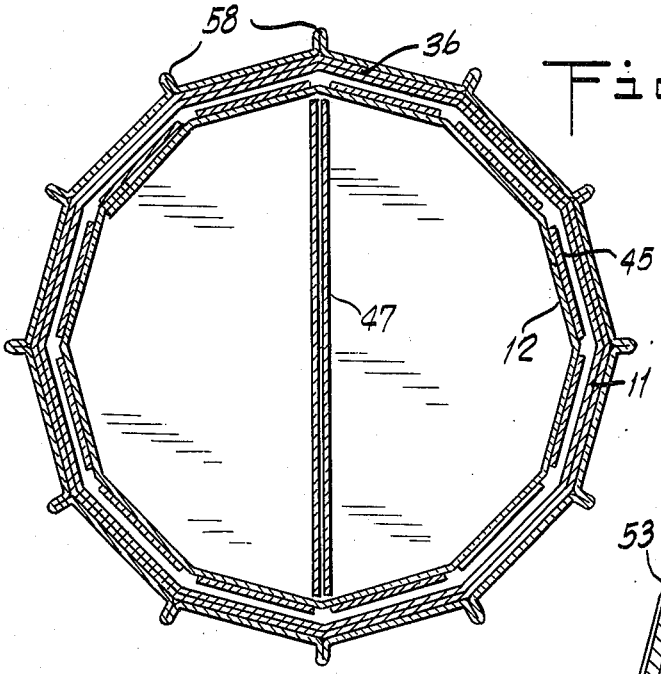
FIGS. 4, 5 and 6 are transverse sections of FIG. 3 as taken at 4—4 to 6—6 inc. thereof respectively.
Figure 5:
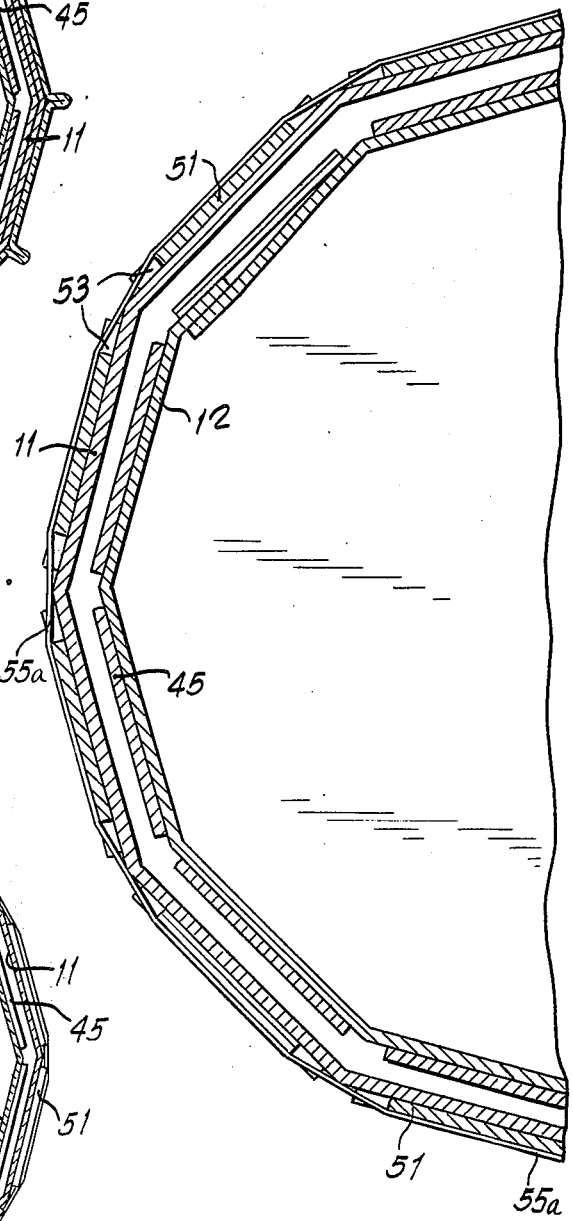
Figure 6:
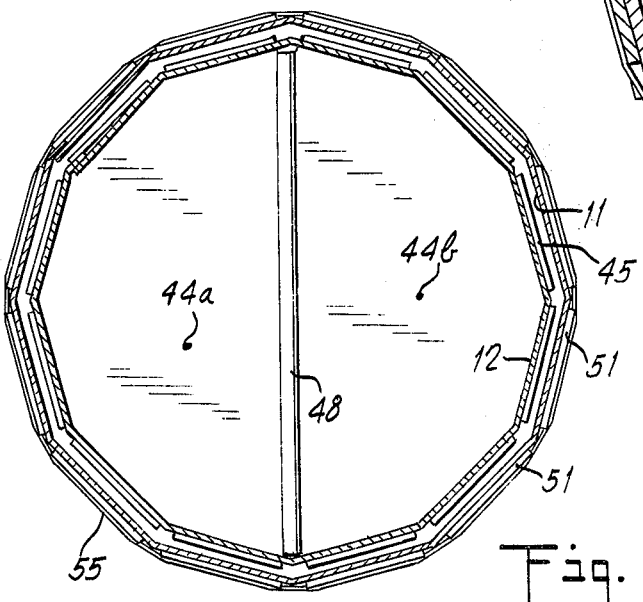

The flaps 45, FIG. 9, of the inner caps, are scored along basal lines 49, for bending normal to the closure portion 43 thereof, for assembling each cap within the outer tubular member 11, with the flaps disposed between the inner wall of the outer tubular member and the outer wall of the inner tubular member 12, in the manner best shown in FIG. 3.

Figure 10:
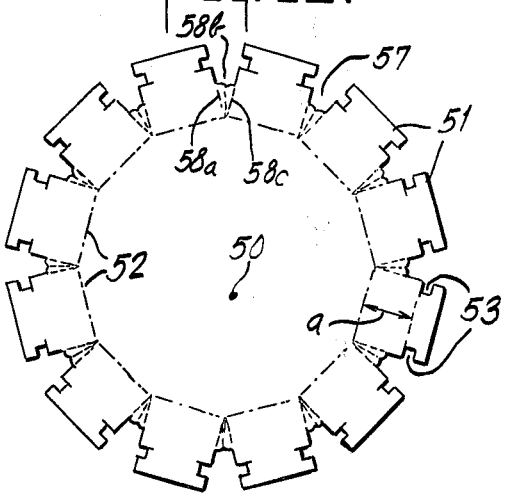
FIG. 10 is a similar view of a blanked out outer closure cap.

Referring to FIG. 10, each of the outer end closure caps 15, 16, is blanked out from flat corrugated board sheet stock into the configuration shown, comprising a central substantially circular, polygonal, closure portion 50, having a series of flaps as at 51, extending radially therefrom. These flaps are scored along their inner ends as at 52, for bending normal to the closure portion 50. The opposite edges of each flap are notched or cut out in their upper portions, as at 53, with the lower edge of each cutout disposed at a distance *a* from its score line 52 which equals the width *a*, FIG. 2 of the collars 36, 37, formed on the ends of the outer tubular member 11. The purpose of this is to provide a means for mounting the outer caps on opposite ends of the outer tubular member in locking assembly thereon by means of an encircling clamping ring in the manner illustrated in FIGS. 1–3 inc. Referring thereto with the bottom outer cap 16 assembled as shown on the lower end of the outer tubular member 11, the collar 37 thereon will extend upward to the height *a*, while the cutout portions 53 in the flaps 51 will be disposed about *a*. Hence by encircling the assembly with an extensible clamping ring 55, the ring will seat against the upper unnotched segments of the flaps 51 and within the notches 53 thereof and against the upper edge of the collar 37, and thus tightly lock the cap onto the end of the tubular member. By way of example assuming the collar to be three inches in width, the cutouts 53 in the flaps 51 will extend from three inches to 3 and ⅝ inches above the fold line 52, and the flaps will be 4 and ¼ inches in overall height.

With the container assembled as above described and open at the top, it is filled with the dry flow material to be packaged. The open container end is then closed by inserting the downwardly bent flaps 43, of the top inner cap 13, FIG. 2, between the inner wall of the outer tube and the outer wall of the inner tube in the manner shown in FIGS. 1 and 3 until said cap is seated on the upper tube ends as shown therein. The top outer cap 15 is then assembled thereon by first encircling the turned down flaps 51, FIG. 2, thereof with an expansible clamping ring, as at 55*a*, FIG. 1, and forcing the cap down over the outer wall of the outer tube 11, until the cap is seated thereon in the manner shown in FIG. 1.

Figure 1:
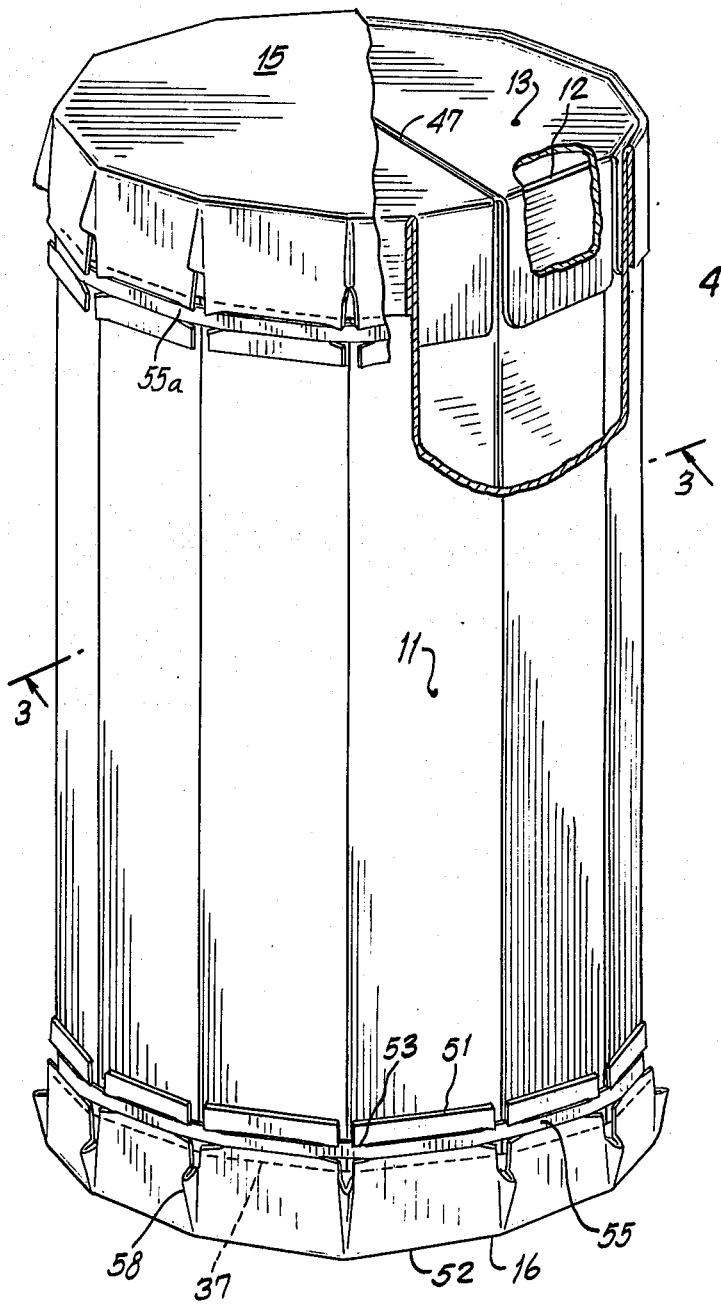
FIG. 1 is a perspective view with parts broken away of the completely assembled container comprising the outer and inner tubes, with top and bottom inner and outer closure caps installed as above explained.

Referring to FIG. 10, for imparting enhanced sift proof properties to the outer closure caps, the basal portions of contiguous flaps 51, are joined by interposed segments 57 integral therewith, each creased by a series of three fold lines, as at 58*a*–58*c* inc., adapted upon bending the flaps normal to the closure portion 50 of the caps to form bellows like folds as at 58 of FIGS. 1 and 2.

From the foregoing description of the invention it will be seen that it incorporates full open head utility for filling, is reclosable at the open end upon partial emptying, and is reusable after complete emptying.

When fine powders are packaged, a polyethylene bag or the like may be inserted to assure completely sift and leak proof properties to the container assembly.

The polygonal configuration of the container can be applied to any substantially circular shape, such as hexagonal, octagonal, etc., and on up to twenty or more panel members. If in useage it is desired to roll the drum-like assembly, about twelve to twenty panels for the tubular members are appropriate. The outer and inner tubular members can comprise single-ply or multi-ply stock, consisting for example as to the latter, of two or more plies of corrugated board bonded together, and the same as applied to the inner and outer closure caps.

What is claimed is:

1. A knock-down, collapsible, drum container assembly, comprising in combination: a pair of polygonal, tubular members one adapted to fit within the other and comprising outer and inner tubular members of said container, each of said members being collapsible to a substantially flat state along oppositely disposed axially extending score lines thereof, end closures for said members comprising pairs of inner and outer closure caps, said inner closure caps being configured to fit within said outer tubular member at the opposite ends thereof and having integral therewith radially extending flaps bendable along score lines to bear against the inner wall of said outer tubular member, said inner tubular member being configured to fit within and bear against said flaps as so disposed, said outer closure caps being configured to span the ends of said outer tubular member and having integral therewith radially extending flaps bendable along score lines into engagement with the outer wall of said outer tubular member, whereby said flaps may be clamped against said outer wall by clamping rings bearing thereagainst.

2. A container assembly according to claim 1, wherein opposite end portions of said outer tubular members are reversely folded onto and adhered to the outer wall thereof to form terminal collars, and wherein the flaps of said outer caps as bent against the outer wall of said tubular member extend beyond said collars, said flaps as so disposed being notched beyond said collars for seating said clamping rings therein in abuttment with and in locking engagement with said collars.

3. A container assembly according to claim 2, wherein said inner caps are reversely bent along transversely extending score lines into strengthening ribs thereof.

4. A container assembly according to claim 3 wherein the basal portions of contiguous flaps of said outer caps are integral with radially scored spanning segments extending therebetween and collapsible into bellows folds upon bending said flaps into engagement with said outer wall of said outer tubular member.

5. A container assembly according to claim 1 wherein each of said tubular members is composed of a substantially rectangular sheet of flexible material having formed therein a plurality of spaced score lines extending parallel to one edge of said sheet and between the edges thereof normal to said one edge, and wherein said one edge is disposed in overlapped relation to the oppositely disposed edge and bonded thereto to form said tube.

6. A knock-down, collapsible, drum container comprising in combination: an outer tubular member, an outer end closure cap for said member, said cap having a closure portion substantially conforming to the outer transverse configuration of said member, said cap having integral therewith a plurality of radially extending flaps bendable along score lines into engagement with the outer wall of said tubular member, a clamping ring encircling said flaps for maintaining the same against said tubular member, an inner closure cap disposed within said outer tubular member and adapted to seat therein against said outer cap, said inner cap having a closure portion conforming substantially to the inner transverse configuration of said outer tubular member and having integral therewith a plurality of radially extending flaps bendable along score lines into engagement with the inner wall of said member, an inner tubular member disposed within said outer tubular member, and being of sufficiently smaller transverse configuration than said outer tubular member to seat at one end thereof on the closure portion of said inner cap and within said flaps thereof.

7. A container according to claim 6 wherein the terminal portion of said outer tubular member engaged by said flaps of said outer cap is reversely and outwardly folded upon itself and secured to the outer wall thereof to form a collar thereabout and wherein said flaps extend beyond said collar and are notched therebeyond for reception of said clamping ring for thereby maintaining said closure cap in locked engagement with said collar.

* * * * *